US009373282B2

(12) United States Patent
Yang

(10) Patent No.: US 9,373,282 B2
(45) Date of Patent: Jun. 21, 2016

(54) PIXEL CIRCUIT FOR INCREASING ACCURACY OF CURRENT SENSING

(71) Applicant: Samsung Display Co., Ltd., Yongin, Gyeonggi-Do (KR)

(72) Inventor: Jin-Wook Yang, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 16 days.

(21) Appl. No.: 14/549,298

(22) Filed: Nov. 20, 2014

(65) Prior Publication Data

US 2015/0145754 A1 May 28, 2015

(30) Foreign Application Priority Data

Nov. 25, 2013 (KR) ..... 10-2013-0143639

(51) Int. Cl.
*G09G 3/32* (2016.01)

(52) U.S. Cl.
CPC ..... *G09G 3/3233* (2013.01); *G09G 2300/0852* (2013.01); *G09G 2300/0861* (2013.01); *G09G 2320/0295* (2013.01); *G09G 2320/045* (2013.01)

(58) Field of Classification Search
CPC ..... G09G 3/3233; G09G 3/3283; G09G 2300/0439; G09G 2300/0469
See application file for complete search history.

(56) References Cited

U.S. PATENT DOCUMENTS

| | | | | |
|---|---|---|---|---|
| 7,459,859 | B2 * | 12/2008 | Tseng | G09G 3/3241 315/169.3 |
| 2003/0112205 | A1 * | 6/2003 | Yamada | G09G 3/3233 345/32 |
| 2004/0004589 | A1 * | 1/2004 | Shih | G09G 3/3233 345/82 |
| 2004/0252089 | A1 * | 12/2004 | Ono | G09G 3/3233 345/82 |
| 2007/0296672 | A1 * | 12/2007 | Kim | G09G 3/3233 345/92 |
| 2008/0088648 | A1 | 4/2008 | Nathan et al. | |
| 2012/0113077 | A1 | 5/2012 | Kang | |
| 2013/0057595 | A1 | 3/2013 | Nathan et al. | |
| 2015/0179107 | A1 * | 6/2015 | Kim | G09G 3/3233 345/212 |

FOREIGN PATENT DOCUMENTS

| | | | |
|---|---|---|---|
| KR | 10-2010-0053233 | A | 5/2010 |
| KR | 10-2012-0048294 | A | 5/2012 |

* cited by examiner

*Primary Examiner* — Kevin M Nguyen
(74) *Attorney, Agent, or Firm* — Knobbe Martens Olson & Bear LLP

(57) ABSTRACT

A pixel circuit for increasing accuracy of current sensing of an organic light-emitting diode (OLED) display is disclosed. In one aspect, the pixel circuit includes an OLED, a driving circuit, and first to third transistors. The driving circuit is configured to adjust a magnitude of a current flowing through the OLED based at least in part on a data signal received from a data line. The first transistor is configured to electrically connect the data line and a holding capacitor based at least in part on a scan signal. The second transistor is configured to electrically connect the holding capacitor and the driving circuit based at least in part on a write control signal. The third transistor is configured to electrically connect the data line and an anode electrode of the OLED based at least in part on a sensing control signal.

11 Claims, 7 Drawing Sheets

PIXEL CIRCUIT FOR INCREASING ACCURACY OF CURRENT SENSING

CROSS-REFERENCE TO RELATED APPLICATIONS

This application claims priority to and the benefit of Korean Patent Application No. 10-2013-0143639 on Nov. 25, 2013, in the Korean Intellectual Property Office, the entire contents of which are incorporated herein by reference in their entirety.

BACKGROUND

1. Field

The described technology generally relates to a pixel circuit of an organic light-emitting diode (OLED) display.

2. Description of the Related Technology

Various flat panel display technologies have a reduced weight and volume compared to cathode ray tubes (CRTs) and are widely used. These technologies include liquid crystal display (LCD), field emission display (FED), plasma display panel (PDP), organic light-emitting diode (OLED) display, and the like.

The OLED display generates an image by using OLEDs that generate light based on electron-hole recombination. Such an OLED has favorable characteristics such as a fast response speed and low power consumption.

SUMMARY OF CERTAIN INVENTIVE ASPECTS

One inventive aspect is a pixel circuit which can increase accuracy of current sensing.

Another aspect is a pixel circuit that includes: an organic light-emitting diode (OLED); a driving circuit configured to adjust a magnitude of a current supplied from a first power source to a second power source through the OLED according to a data signal supplied through a data line; a first transistor configured to connect the data line and a holding capacitor in response to a scan signal; a second transistor configured to connect the holding capacitor and the driving circuit in response to a write control signal; and a third transistor configured to connect the data line and an anode electrode of the OLED in response to a sensing control signal.

The scan signal can be supplied during a third period after a first period and a second period.

The write control signal can be supplied during the second period after the first period.

The sensing control signal can be supplied during a fourth period after the third period.

The data line can be connected to a sensing unit during a fifth period including the third period and the fourth period.

The data signal can be supplied to the data line during the first period.

A reference voltage can be supplied to the data line during the third period.

The driving circuit can include a driving transistor having a first electrode connected to the first power source, a second electrode connected to the anode electrode of the OLED, and a gate electrode connected to the second transistor; and a storage capacitor connected between the first electrode and the gate electrode of the driving transistor.

Another aspect is a pixel circuit that includes: an organic light-emitting diode (OLED); a driving circuit configured to adjust a magnitude of a current supplied from a first power source to a second power source through the OLED according to a data signal supplied through a data line; a first transistor configured to connect the data line and a holding capacitor in response to a scan signal; a second transistor configured to connect the holding capacitor and the driving circuit in response to a write control signal; a third transistor configured to connect the data line and an anode electrode of the OLED in response to a sensing control signal; and a fourth transistor configured to connect the data line and the holding capacitor in response to an initialization control signal.

The scan signal can be supplied during a first period, in synchronization with the data signal.

The write control signal can be supplied during a second period after the first period.

The initialization control signal can be supplied during a third period after the second period.

The sensing control signal can be supplied during a fourth period after the third period.

The data line can be connected to a sensing unit during a fifth period including the third period and the fourth period.

A reference voltage can be supplied to the data line during the third period.

Another aspect is an organic light-emitting diode (OLED) display, comprising an OLED a driving transistor, a write control transistor and a sensing control transistor. The driving transistor is configured to adjust a current flowing through the OLED based at least in part on a driving signal. The write control transistor is configured to receive a data signal and output the driving signal to the driving transistor based at least in part on a write control signal. The sensing control transistor configured to receive the data signal and output a sensing signal to a node located between the driving transistor and the OLED.

The above display further comprises a scan transistor configured to provide a scan response signal to the write control transistor based at least in part on a scan signal. The above display further comprises a holding capacitor electrically connected between the write control transistor and the scan transistor, and configured to store the scan response signal.

Another aspect is an organic light-emitting diode (OLED) display, comprising a data driver, a sensor and a data converter. The data driver is configured to provide voltage to a data line and voltage to a holding capacitor, wherein the voltage of the data line and the holding capacitor are substantially the same for a selected period of time. The sensor is configured to provide a first current to an anode of an OLED, wherein the sensor is configured to measure a sensing voltage corresponding to the first current and output current information corresponding to the sensing voltage. The data converter is configured to generate image data based at least in part on the current information.

In the above display, the current information is degradation information of the OLED. The above display further comprises a driving transistor configured to provide a second current to the sensor, wherein the sensor is further configured to generate the current information based on the second current. The above display further comprises a scan transistor configured to electrically connect the data line and the holding capacitor in response to a scan signal. The above display further comprises a write control transistor configured to electrically connect the holding capacitor and a gate electrode of the driving transistor in response to a write control signal. The above display further comprises a sensing control transistor configured to electrically connect the anode of the OLED and the sensor in response to a sensing control signal.

Another aspect is an organic light-emitting diode (OLED) display, comprising a plurality of pixels. At least one of the pixels comprises an OLED, a driving circuit and first to third transistors. The driving circuit is configured to adjust a magnitude of current flowing through the OLED based at least in part on a data signal received from a data line. The first transistor is configured to electrically connect the data line and a holding capacitor based at least in part on a scan signal. The second transistor is configured to electrically connect the holding capacitor and the driving circuit based at least in part on a write control signal. The third transistor is configured to electrically connect the data line and an anode electrode of the OLED based at least in part on a sensing control signal.

The above OLED display further comprises a scan driver configured to provide the scan signal during a first period and a third period after a second period. The above OLED display further comprises a timing controller configured to provide the write control signal during the second period after the first period. The above OLED display further comprises a control line driver configured to provide the sensing control signal during a fourth period after the third period.

In the above OLED display, the data line is electrically connected to the sensor during a fifth period that includes the third and fourth periods. The above OLED display further comprises a data driver configured to provide the data signal to the data line during the first period. The above OLED display further comprises a sensor configured to provide a reference voltage to the data line during the third period.

In the above OLED display, the driving circuit comprises a driving transistor and a storage capacitor. In the above OLED display, the driving transistor includes i) a first electrode electrically connected to a first power source, ii) a second electrode electrically connected to the anode electrode of the OLED, and iii) a gate electrode electrically connected to the second transistor. In the above OLED display, the storage capacitor is electrically connected between the first electrode and the gate electrode of the driving transistor.

The above OLED display further comprises a fourth transistor configured to electrically connect the data line and the holding capacitor based at least in part on an initialization control signal. The above OLED display further comprises a scan driver configured to provide the scan signal during a first period. The above OLED display further comprises a control line driver configured to provide the initialization control signal during a third period after the second period.

The pixel circuit according to an embodiment blocks a reverse current that can flow from a capacitor thereof to a data line, thus enhancing accuracy of current sensing.

BRIEF DESCRIPTION OF THE DRAWINGS

Example embodiments will now be described more fully hereinafter with reference to the accompanying drawings; however, they can be embodied in different forms and should not be construed as limited to the embodiments set forth herein. Rather, these embodiments are provided so that this disclosure will be thorough and complete, and will full convey the scope of the example embodiments to those skilled in the art.

In the drawing figures, dimensions can be exaggerated for clarity of illustration. It will be understood that when an element is referred to as being "between" two elements, it can be the only element between the two elements, or one or more intervening elements can also be present. Like reference numerals refer to like elements throughout.

DETAILED DESCRIPTION OF CERTAIN INVENTIVE EMBODIMENTS

An organic light-emitting diode (OLED) display can have brightness variations (or luminance deviations) generated between respective pixels due to variations in manufacturing or non-uniform degradation over time. Such brightness variations can negatively impact image quality.

Hereinafter, embodiments of the described technology will be described in detail with reference to the accompanying drawings.

Figure 1:
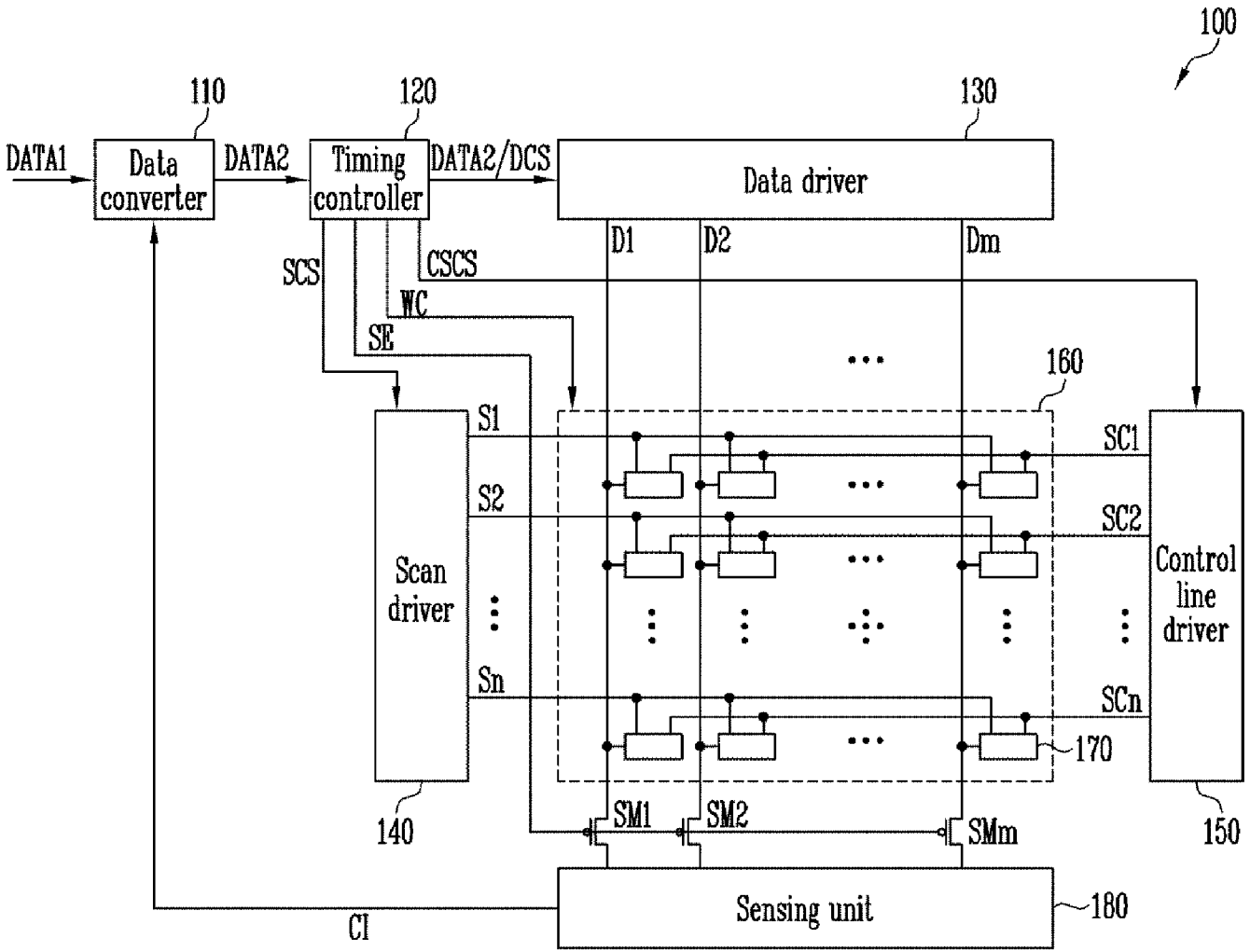
FIG. 1 is a view illustrating an organic light-emitting diode (OLED) display according to a first embodiment.
Figure 2:
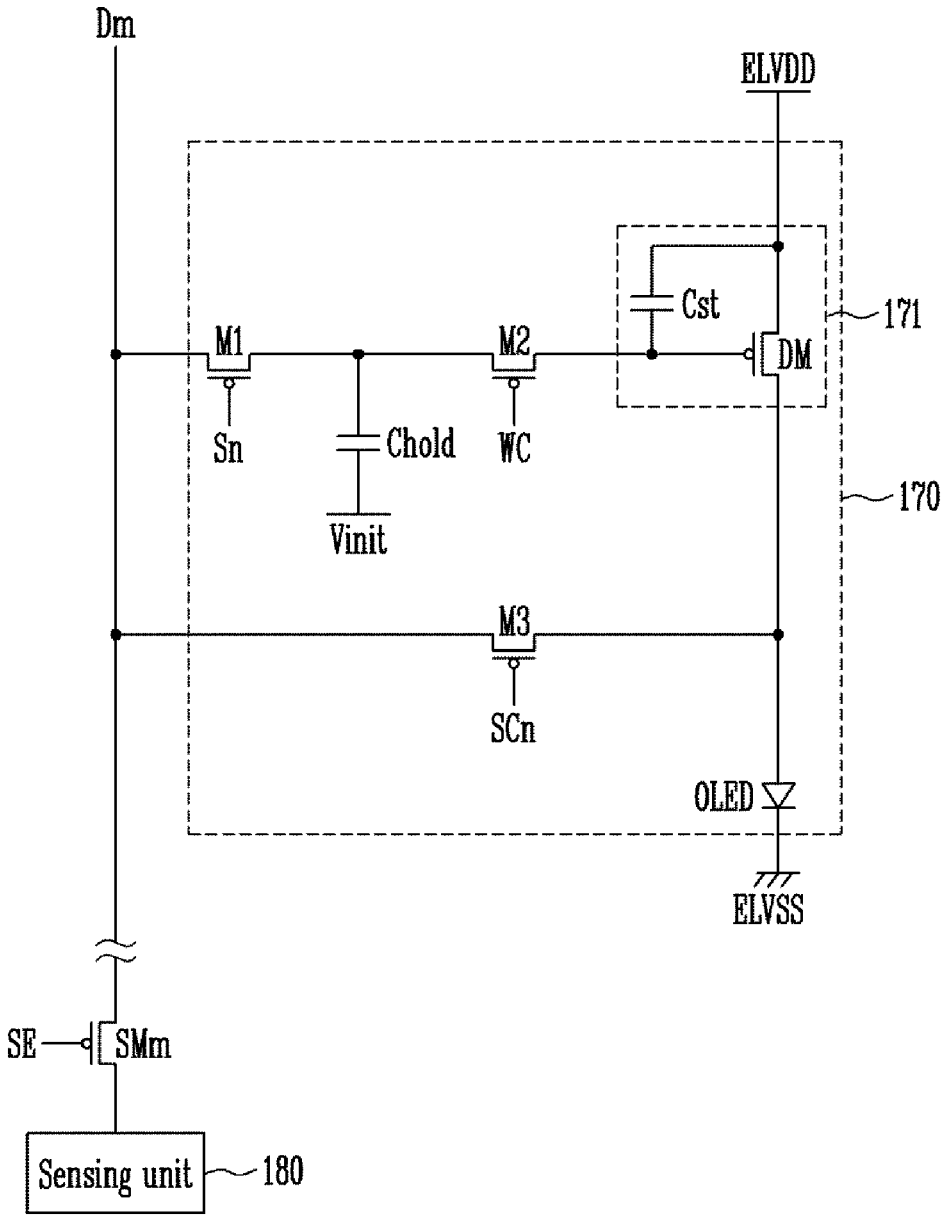
FIG. 2 is a detailed circuit diagram illustrating the pixel circuit illustrated in FIG. 1.

Referring to FIG. 1, the organic light-emitting diode display 100 includes a data converter 110, a timing controller 120, a data driver 130, a scan driver 140, a control line driver 150, a display unit 160, and a sensing unit or sensor 180.

The data converter 110 converts first image data DATA1 supplied from an external device (for example, an application processor of a host) into second image data DATA2. For example, the data converter 110 converts the first image data DATA1 into the second image data DATA2 such that a brightness variation (or a luminance deviation) of each of pixels 170 can be compensated in response to current information CI supplied from the sensing unit 180. The data converter 110 supplies the second image data DATA2 to the timing controller 120.

The timing controller 120 controls operations of the data driver 130, the scan driver 140, and the control line driver 150, in response to a synchronizing signal (not shown), For example, the timing controller 120 generates and supplies a data driving control signal DCS to the data driver 130. The timing controller 120 generates and supplies a scan driving control signal SCS to the scan driver 140. The timing controller 120 generates and supplies a control line driving control signal CSCS to the control line driver 150.

In some embodiments, the timing controller 120 supplies the second image data DATA2 to the data driver 130, in synchronization with the data driving control signal DCS, the scan driving control signal SCS, and the control line driving control signal CSCS.

Also, the timing controller 120 supplies a write control signal to the pixels 170 through a write control line WC during a third period T3. The timing controller 120 supplies a sensing enable signal SE to a plurality of transistors SM1 to SMm during a fifth period T5. The transistors SM1 to SMm are electrically connected between a plurality of data lines D1 to Dm and the sensing unit 180, and turned on in response to the sensing enable signal SE.

In response to the data driving control signal DCS, the data driver 130 reorders the second image data DATA2 and supplies data signals to the data lines D1 to Dm during a first period T1.

In response to the scan driving control signal SCS, the scan driver 140 sequentially supplies scan signals to a plurality of scan lines S1 to Sn during the first period T1 and the third period T3.

In response to the control line driving control signal CSCS, the control line driver 150 sequentially supplies sensing control signals to a plurality of sensing control lines SC1 to SCn during a fourth period T4.

Figure 3:
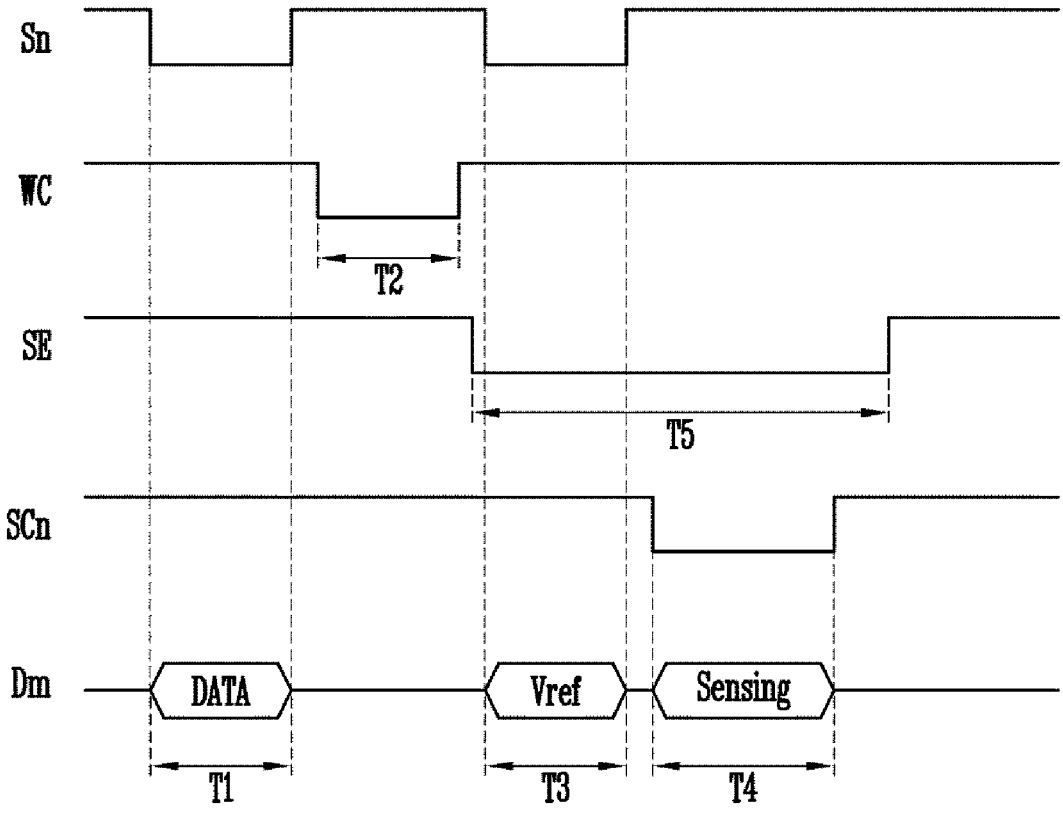
FIG. 3 is a timing diagram of control signals supplied to the pixel circuit illustrated in FIG. 2.

As illustrated in FIG. 3, the first period T1, the second period T2, the third period T3, and the fourth period T4 sequentially arrive, and the fifth period T5 includes the third period T3 and the fourth period T4. In FIG. 3, the first period T1, the second period T2, the third period T3, and the fourth period T4 have substantially similar time durations, but they are not limited thereto. For example, the first period T1, the third period T3, and the fourth period T4 can be longer than the second period T2. The scan signals or the sensing control signals can be sequentially supplied to the pixels 170.

In FIG. 1, the data converter 110 and the timing controller 120 are illustrated as separate components, but they are not limited thereto. For example, the data converter 110 and the timing controller 120 can be implemented as a single integrated circuit (IC).

In FIG. 1, the scan driver 140 and the control line driver 150 are illustrated as separate components, but they are not limited thereto. For example, the scan driver 140 and the control line driver 150 can be implemented as a single integrated circuit (IC).

The display unit 160 includes the pixels 170 formed at intersections of the data lines D1 to Dm, the scan lines S1 to Sn, and the sensing control lines SC1 to SCn. In some embodiments, the data lines D1 to Dm are arranged in a vertical direction, and the scan lines S1 to Sn and the sensing control lines SC1 to SCn are arranged in a horizontal direction.

The pixels 170 are electrically connected to corresponding data lines among the data lines D1 to Dm, corresponding scan lines among the scan lines S1 to Sn, and corresponding sensing control lines among the sensing control lines SC1 to SCn. Each of the pixels 170 includes a driving circuit 171, a first transistor or scan transistor M1, a second transistor or write control transistor M2, a third transistor or sensing control transistor M3, a holding capacitor Chold, and an organic light-emitting diode (OLED).

The driving circuit 171 adjusts a magnitude of a current applied from a first power source ELVDD to a second power source ELVSS through the OLED according to the data signal.

The driving circuit 171 can include a driving transistor DM and a storage capacitor Cst. A first electrode of the driving transistor DM is electrically connected to a node between the first power source ELVDD and a first end of the storage capacitor Cst, a second electrode thereof is electrically connected to an anode electrode of the OLED, and a gate electrode thereof is electrically connected to a node between a first electrode of the second transistor M2 and a second end of the storage capacitor Cst.

The first electrode refers to a source electrode or a drain electrode, and the second electrode refers to the other electrode.

A first electrode of the first transistor M1 is electrically connected to the data line Dm, a second electrode thereof is electrically connected to a node between a first end of the holding capacitor Chold and a second electrode of the transistor M2, and a gate electrode thereof is electrically connected to the scan line Sn. The first transistor M1 is turned on in response to the scan signal supplied to the scan line Sn.

In response to the scan signal supplied during the first period T1 and the third period T3, the first transistor M1 is turned on during the first and third periods T1 and T3. Thus, a voltage in the data line Dm and a voltage charged in the holding capacitor Chold are substantially the same during the two periods T1 and T3.

During the first period T1, the data signal is supplied through the data line Dm, and the holding capacitor Chold charges a voltage (hereinafter, referred to as a 'data voltage') corresponding to the data signal. During the third period T3, a reference voltage is supplied through the data line Dm from the sensing unit 180 and the holding capacitor Chold charges the reference voltage.

The first electrode of the second transistor M2 is electrically connected to the node between the second electrode of the second transistor M2 and the first end of the holding capacitor Chold. The second electrode of the second transistor M2 is electrically connected to the driving circuit 171, and a gate electrode thereof is electrically connected to the write control line WC. The second transistor M2 is turned on in response to a write control signal.

When the write control signal is supplied during the second period T2, the second transistor M2 is turned on during the period T2. Thus, the second transistor M2 delivers the data voltage charged in the holding capacitor Chold during the first period T1 to the storage capacitor Cst of the driving circuit 171 during the second period T2.

A first electrode of the third transistor M3 is electrically connected to the node between the anode electrode of the OLED and the second electrode of the driving transistor DM, a second electrode thereof is electrically connected to the data line Dm, and a gate electrode thereof is electrically connected to the sensing control line SCn. The third transistor M3 is turned on in response to the sensing control signal supplied through the sensing control line SCn.

When the sensing control signal is supplied during the fourth period T4, the third transistor M3 generates a current path from the driving transistor DM or the OLED to the sensing unit 180 during the fourth period T4.

During the fourth period T4, the pixel 170 supplies circuit information to the sensing unit 180 through the data line Dm. For example, the circuit information can include threshold voltage/mobility information of the driving transistor DM and/or degradation information of the OLED. The information can be supplied in the form of a current or a voltage.

The holding capacitor Chold is electrically connected to the node between the second electrode of the first transistor M1 and the first electrode of the second transistor M2 at the first end, and a third power source Vinit at a second end. A voltage of the third power source Vinit can vary according to circuit designs.

The OLED is electrically connected between the driving circuit 171 and the second power source ELVSS. The OLED emits light having luminance corresponding to a current supplied from the driving circuit 171.

The sensing unit 180 extracts the threshold voltage/mobility and degradation information from the pixels 170, and supplies the extracted information as current information CI to the data converter 110 during period T4.

The transistors SM1 to SMm are electrically connected between the data lines D1 to Dm and the sensing unit 180 The transistors SM1 to SMm are turned on in response to the sensing enable signal SE.

When the sensing enable signal SE is supplied during the fifth period T5, the transistors SM1 to SMm are turned on during the period T5. As a result, the sensing unit 180 and the pixels 170 are electrically connected.

During the third period T3 included in the fifth period T5, the sensing unit 180 supplies the reference voltage to the holding capacitor Chold. The reference voltage can be set according to whether the threshold voltage/mobility information is sensed or whether the degradation information is sensed.

During the third period T3, the voltage of the data lines D1 to Dm and the voltage charged in the holding capacitor Chold are substantially the same. As a result, a reverse current from the holding capacitor Chold to the data lines D1 to Dm does not occur.

Figure 4:
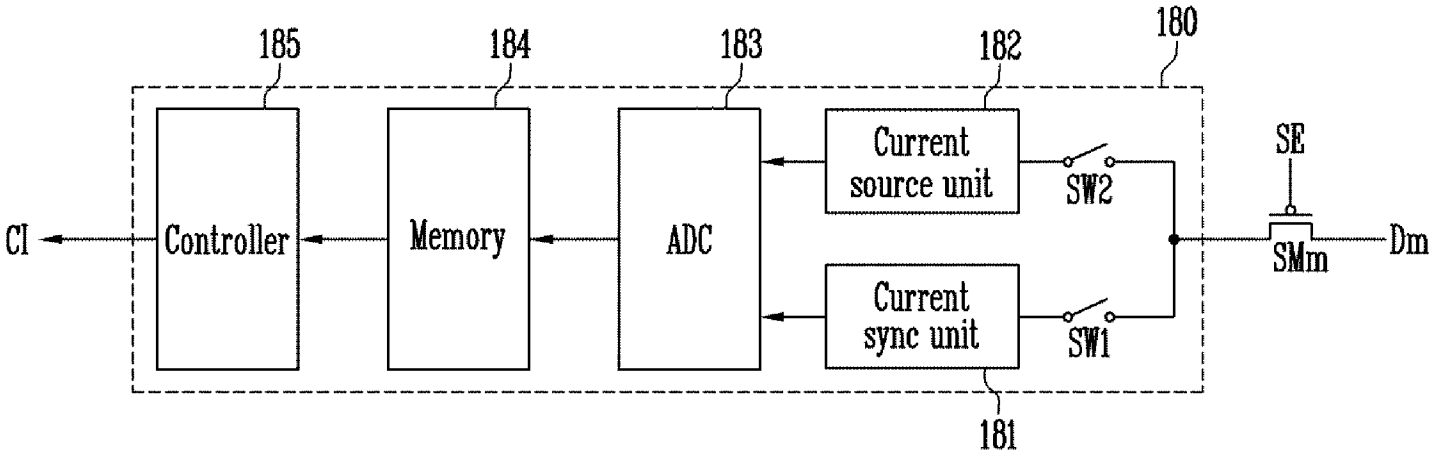
FIG. 4 is a detailed block diagram illustrating a sensing unit illustrated in FIG. 1.

Referring to FIG. 4, the sensing unit 180 includes a first and second switches SW1 and SW2, a current synchronizing unit (or current sync unit or synchronizer) 181, a current source unit 182, an analog-to-digital converter (ADC) 183, a memory 184, and a controller 185.

The first switch SW1 controls an electrical connection between the current sync unit 181 and any one of the data lines D1 to Dm. For example, the first switch SW1 is turned on when the threshold voltage/mobility information is sensed.

The second switch SW2 controls an electrical connection between the current source unit 182 and any one of the data lines D1 to Dm. For example, the second switch SW2 is turned on when the degradation information is sensed.

When the first switch SW1 is turned on, the current sync unit 181 receives a predetermined current from any one of the pixels 170, senses the threshold voltage/mobility information, and outputs a first voltage corresponding to the predetermined current to the ADC 183.

When the second switch SW2 is turned on, the current source unit 182 senses the threshold voltage information, while supplying a predetermined current to the pixel 170. In other words, the current source unit 182 supplies a predetermined current to the OLED, outputs a second voltage across the OLED, to the ADC 183.

The ADC 183 converts the first voltage supplied into a first digital value and converts the second voltage into a second digital value.

The memory 184 stores the first and second digital values corresponding to each of the pixels 170. In some embodiments, the memory 184 can be implemented as a frame memory.

The controller 185 supplies the first and second digital values as the current information CI to the data converter 110.

By rendering a voltage of the data line Dm and a voltage of the holding capacitor Chold substantially equal to the reference voltage during the third period T3, the sensing unit 180 can generate the current information CI without noise caused by a reverse current. Thus, the data converter 110 can generate the second data DATA2 such that a brightness variation of each of the pixels 170 can be substantially accurately compensated.

Figure 5:
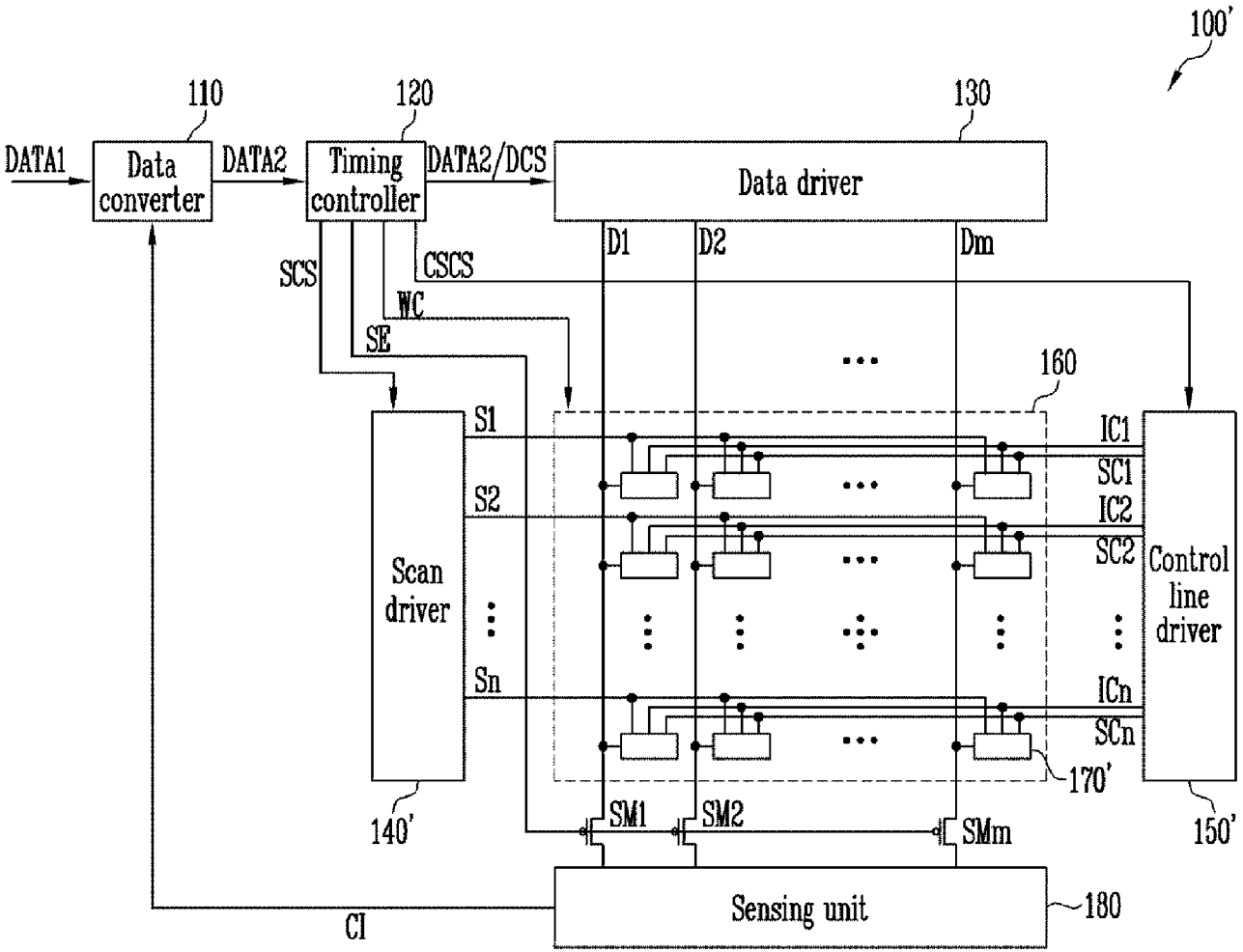
FIG. 5 is a block diagram illustrating an OLED display according to a second embodiment.
Figure 6:
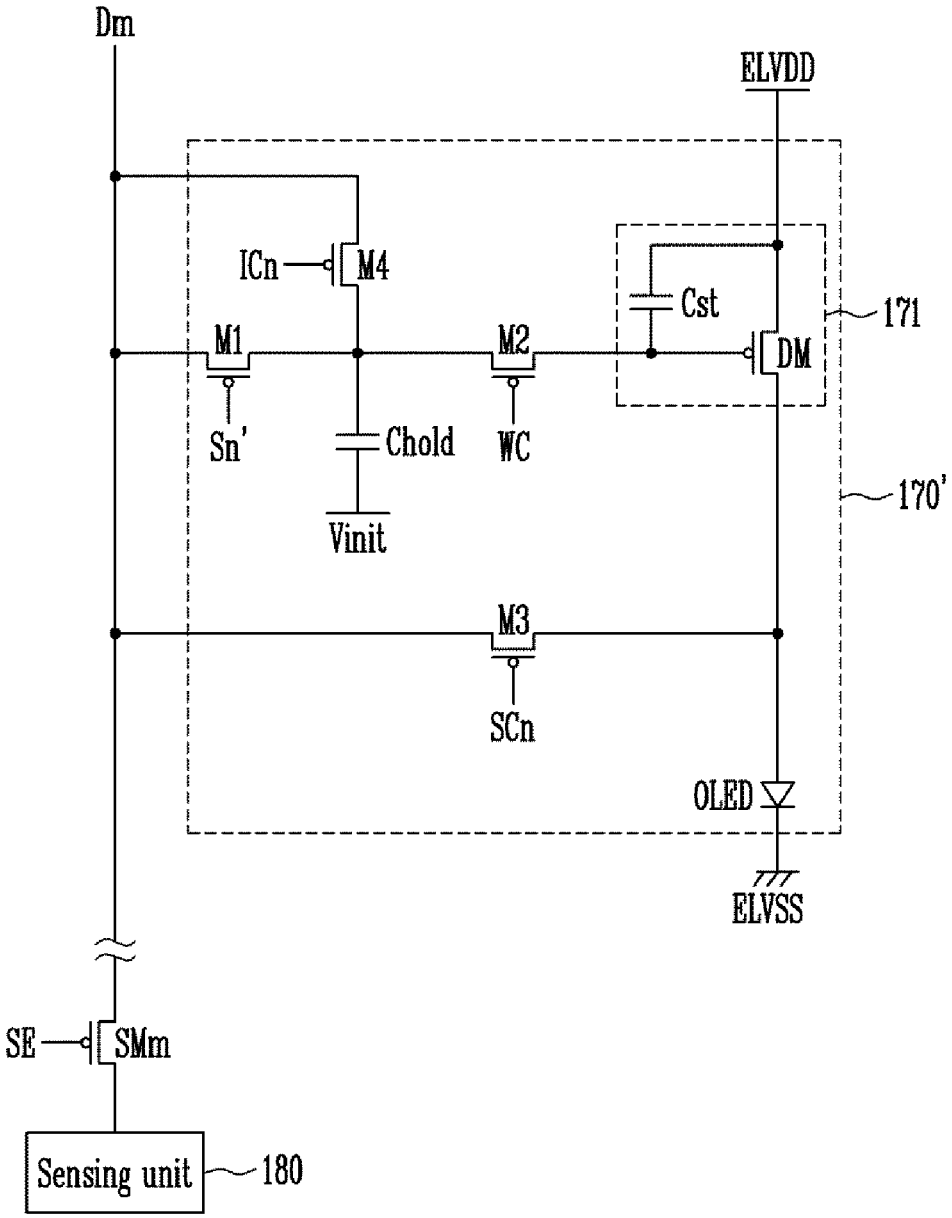
FIG. 6 is a detailed circuit diagram illustrating the pixel circuit illustrated in FIG. 5.
Figure 7:
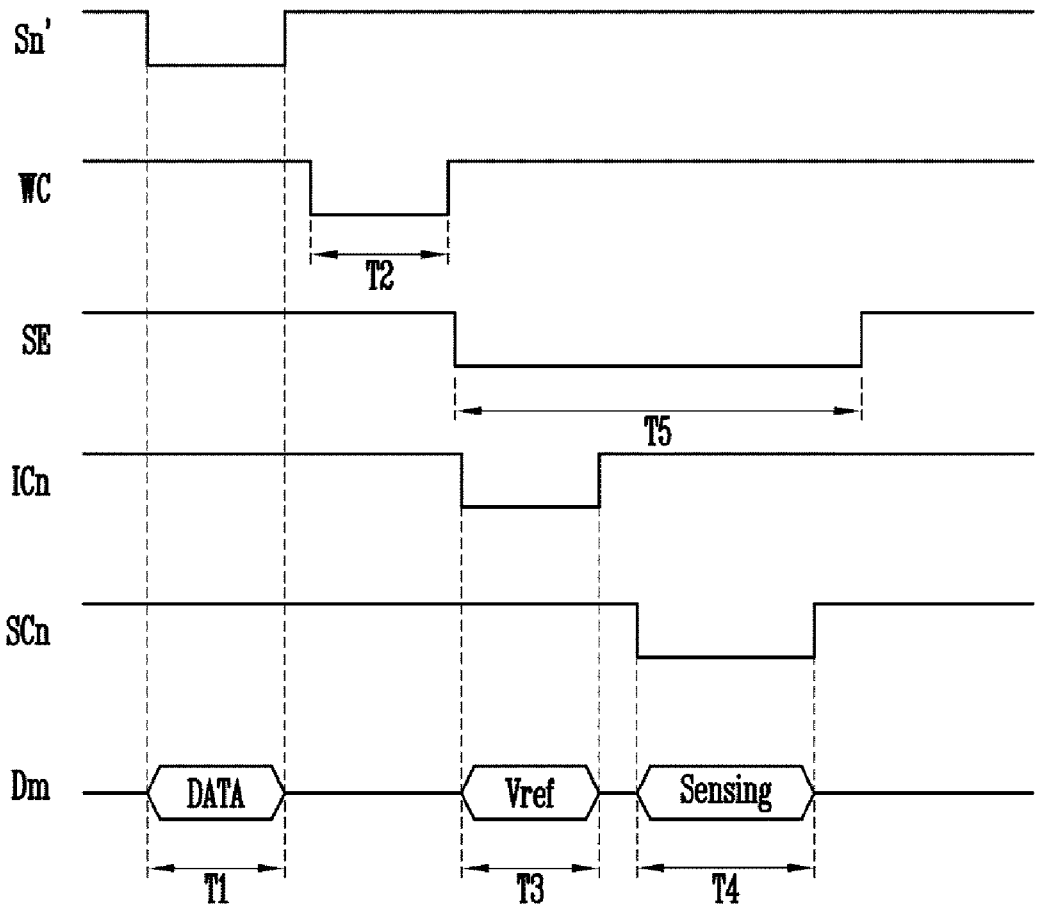
FIG. 7 is a timing diagram of control signals supplied to the pixel circuit illustrated in FIG. 6.

FIG. 5 is a block diagram illustrating an organic light-emitting diode or OLED display 100' according to a second embodiment. FIG. 6 is a detailed circuit diagram illustrating the pixel circuit illustrated in FIG. 5. FIG. 7 is a timing diagram of control signals supplied to the pixel circuit illustrated in FIG. 6.

The OLED display 100' and a pixel circuit 170' illustrated in FIGS. 5 through 7 are substantially the same as the OLED display 100 and the pixel circuit 170 except that the scan signal is supplied during the first period T1 and a fourth transistor M4 is provided.

Referring to FIGS. 5 through 7, a scan driver 140' sequentially supplies scan signals to scan lines S1 to Sn in response to the scan driving control signal SCS output during the first period T1.

When the scan signals are supplied during the first period T1, the first transistor M1 is turned on during the period T1. When the data signal is supplied from the data driver 130 during the first period T1, the holding capacitor Chold charges the data voltage. Thus, the voltage of the data line Dm and the voltage charge in the holding capacitor Chold are substantially the same during the first period T1.

In response to the control line driving control signal CSCS, a control line driver 150' sequentially supplies sensing control signals to the sensing control lines SC1 to SCn during the third period T3 and sequentially supplies initialization control signals to a plurality of initialization control lines IC1 to ICn during the fourth period T4.

Each of the pixels 170' further includes the fourth transistor M4 in comparison to the pixels 170.

A first electrode of the fourth transistor M4 is electrically connected to the data line Dm. A second electrode thereof is electrically connected to the node that electrically connects the second electrode of the first transistor M1, the first electrode of the second transistor M2, and the first end of the holding capacitor Chold. A gate electrode of the fourth transistor M4 is electrically connected to the initialization control line ICn.

When the initialization control signal is supplied during the third period T3, the fourth transistor M4 is turned on during the period T3. When the reference voltage is supplied during the third period T3, the holding capacitor Chold charges the reference voltage. Thus, the voltage of the data line Dm and the voltage charged in the holding capacitor Chold are substantially the same during the third period T3. Therefore, a reverse current from the holding capacitor Chold to the data lines D1 to Dm does not occur.

In order to compensate for brightness variations between pixels, various methods have been employed and researched. For example, the threshold voltage/mobility of the driving transistor included in pixels is measured by sensing a current flowing through the driving transistor, and the degradation of an OLED is measured by sensing the current flowing through the OLED.

In some embodiments, the pixel circuit can cut off the reverse current that can flow from a capacitor thereof to the data line, thus enhancing the accuracy of current sensing.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment can be used singly or in combination with features, characteristics, and/or elements described in connection with other embodiments unless otherwise specifically indicated. Accordingly, it will be understood by those of skill in the art that various changes in form and details can be made without departing from the spirit and scope of the described technology as set forth in the following claims.

What is claimed is:

1. An organic light-emitting diode (OLED) display, comprising:

a plurality of pixels, wherein at least one of the pixels comprises:

an OLED;

a driving circuit configured to adjust a magnitude of current flowing through the OLED based at least in part on a data signal received from a data line;

a first transistor configured to electrically connect the data line and a holding capacitor based at least in part on a scan signal;

a second transistor configured to electrically connect the holding capacitor and the driving circuit based at least in part on a write control signal; and a third transistor configured to electrically connect the data line and an anode electrode of the OLED based at least in part on a sensing control signal.

2. The OLED display of claim 1, further comprising a scan driver configured to provide the scan signal during a first period and a third period after a second period.

3. The OLED display of claim 2, further comprising a timing controller configured to provide the write control signal during the second period after the first period.

4. The OLED display of claim 3, further comprising a control line driver configured to provide the sensing control signal during a fourth period after the third period.

5. The OLED display of claim 4, wherein the data line is electrically connected to the sensor during a fifth period that includes the third and fourth periods.

6. The OLED display of claim 4, further comprising a data driver configured to provide the data signal to the data line during the first period.

7. The OLED display of claim 4, further comprising a sensor configured to provide a reference voltage to the data line during the third period.

8. The OLED display of claim 1, wherein the driving circuit comprises:

a driving transistor including i) a first electrode electrically connected to a first power source, ii) a second electrode electrically connected to the anode electrode of the OLED, and iii) a gate electrode electrically connected to the second transistor; and a storage capacitor electrically connected between the first electrode and the gate electrode of the driving transistor.

9. The OLED display of claim 1, further comprising a fourth transistor configured to electrically connect the data line and the holding capacitor based at least in part on an initialization control signal.

10. The OLED display of claim 1, further comprising a scan driver configured to provide the scan signal during a first period.

11. The OLED display of claim 9, further comprising a control line driver configured to provide the initialization control signal during a third period after the second period.

* * * * *